US005668436A

United States Patent [19]

Honda et al.

[11] Patent Number: 5,668,436

[45] Date of Patent: Sep. 16, 1997

[54] CATHODE RAY TUBE DISPLAYS HAVING SADDLE-TYPE DEFLECTING COILS

[75] Inventors: Masanobu Honda; Toshio Ose, both of Osaka, Japan

[73] Assignee: Matsushita Electronics Corporation, Takatsuki, Japan

[21] Appl. No.: 692,231

[22] Filed: Aug. 7, 1996

[51] Int. Cl.[6] ..... H01J 29/70; H01F 3/00

[52] U.S. Cl. ..... 313/440; 313/413; 313/426; 335/213

[58] Field of Search ..... 313/440, 421, 313/426, 45, 46, 413; 335/210, 213, 299; 348/829

[56] References Cited

U.S. PATENT DOCUMENTS

| | | | |
|---|---|---|---|
| 5,013,964 | 5/1991 | Vink et al. | 313/440 |
| 5,121,028 | 6/1992 | Milili | 335/213 X |
| 5,306,982 | 4/1994 | Maillot et al. | 313/440 X |
| 5,355,050 | 10/1994 | Sluyterman | 313/440 |
| 5,506,469 | 4/1996 | Vink et al. | 313/440 |

FOREIGN PATENT DOCUMENTS

| | | |
|---|---|---|
| 0 424 888 A2 | 5/1991 | European Pat. Off. . |
| 0 424 946 A2 | 5/1991 | European Pat. Off. . |
| 0 700 067 A1 | 3/1996 | European Pat. Off. . |
| 59-186239 | 10/1984 | Japan . |
| 59-186239 | 2/1985 | Japan . |
| 60-175345 | 9/1985 | Japan . |

OTHER PUBLICATIONS

Kuramoto et al., "The SSC Deflection Yoke For In-Line Color CRTs", Proceedings of the SID, vol. 30, No. 1, New York, New York, Dec. 1989.

*Primary Examiner*—Ashok Patel
*Attorney, Agent, or Firm*—Morrison & Foerster, LLP

[57] ABSTRACT

A cathode ray tube display which can reduce the temperature rise of its deflection yoke, not by using either extra-fine wires or litz wires but by increasing the heat radiation of its saddle-type coils, is provided. A deflection yoke arranged in the rear periphery of a cathode ray tube display main body includes a saddle-type horizontal deflection coil, an insulating frame located outside of the saddle-type horizontal deflection coil, a saddle-type vertical deflection coil and a ferrite core located outside the insulating frame. The surface of the saddle-type horizontal deflection coil is partially exposed from the screen-side end face of the ferrite core toward the screen, and the surface area of the exposed part is predetermined to be from 100 to 298 $cm^2$. Similarly, the exposed surface area of the saddle-type vertical deflection coil is predetermined to be from 55 to 185 $cm^2$.

2 Claims, 5 Drawing Sheets

CATHODE RAY TUBE DISPLAYS HAVING SADDLE-TYPE DEFLECTING COILS

BACKGROUND OF THE INVENTION

This invention relates to cathode ray tube displays having saddle-type deflecting coils, more specifically, cathode ray tube displays improved to reduce temperature rise of their deflection yokes.

Recently, the amount of information displayed on monitors is increasing as the demands of operating systems such as Windows (the operating system by Microsoft) increase. As a result, higher display resolutions are required. For example, resolution of 1024×768 dots has been generalized for personal computers, and resolution of 1600×1028 dots has become more popular for work station usages. Displays having a white background are frequently used in Windows. As a result, the average luminance of the screen increases and flickers often become noticiable. Therefore, the vertical deflection frequency is generally predetermined to be at least 70 Hz while the conventional frequency is 60 Hz.

As the resolution becomes higher and the vertical deflection frequency increases, the horizontal deflection frequency inevitably rises. As a result, the increased temperature of the deflection yoke attached to a cathode ray tube display becomes problematic.

Several methods to reduce such a temperature rise have been disclosed in various references including Published Unexamined Japanese Patent Application No. Sho 59-186239. For example, reducing the diameter of the bare wire which forms the saddle-type coils of the deflection yoke is to no more than 0.15 mm reduces the temperature rise due to skin effect. Also, temperature rise due to eddy current loss can be reduced by using litz wires.

However, several drawbacks are found in the above-mentioned methods of forming saddle-type coils. For instance, the wires are easily broken in the winding process, or the cost of the wire material is prohibitive.

SUMMARY OF THE INVENTION

This invention aims to provide cathode ray tube displays which reduce the temperature rise of the deflection yokes without using either extra-fine wires or litz wires. For this purpose, the radiation of heat from the saddle-type coils is increased.

In order to achieve this goal, the cathode ray tube display of this invention comprises a cathode ray tube main body and a deflection yoke located at the rear periphery of the main body. The deflection yoke comprises a saddle-type horizontal deflection coil, an insulating frame located outside the saddle-type horizontal deflection coil, a saddle-type vertical deflection coil and a ferrite core located outside the insulating frame. The saddle-type horizontal deflection coil is partially exposed from the screen-side end face of the ferrite core toward the screen. The first structural characteristic of this invention is that the surface area of the exposed portion of the saddle-type horizontal deflection coil is predetermined to be from 100 $cm^2$ to 298 $cm^2$.

The saddle-type vertical deflection coil is also partially exposed from the screen-side end face of the ferrite core toward the screen. The second structural characteristic of this invention is that the surface area of the exposed portion of the saddle-type vertical deflection coil is predetermined to be from 55 $cm^2$ to 185 $cm^2$.

According to the first or second structure, the exposed portion of either the saddle-type horizontal deflection coil or the saddle-type vertical deflection coil is increased so that the heat radiation effect is improved. Therefore, the temperature rise of the deflection yoke can be reduced without using either extra-fine wires or litz wires. The details are as follows.

When a deflection yoke operates, its energy loss changes into heat, thus the temperature rises. The temperature begins to rise as the operation starts, and reaches equilibrium after a predetermined amount of time. The energy loss of the saddle-type coils is very high, and is the main factor in the temperature rise of the deflection yoke. As the horizontal deflection frequency becomes high, the ohmic loss due to the skin effect of the wires forming the saddle-type coils and eddy current loss on the saddle-type coils increase. As a result, the temperature rise of the deflection yoke becomes remarkable. In order to reduce such a temperature rise, several methods have been proposed. For example, the heating-up is reduced by decreasing the ohmic loss and the eddy current loss of the saddle-type coils. Another method is to promote the heat radiation from the deflection yoke (saddle-type coils). This invention focuses on the latter method.

The temperature of the saddle-type coils of the deflection yoke changes corresponding to time. In the following equation, "Q" indicates the heat which the saddle-type coils generate in a unit time. "W" indicates the mass of the saddle-type coils. "A" indicates the surface area of the saddle-type coils. "a" indicates the heat radiation coefficient. "c" indicates the specific heat of the saddle-type coils, and "θ" indicates the temperature rise. The heat generated during the time dt is Qdt. This heat partially raises the temperature of the saddle-type coils by dθ, and the rest of the heat is radiated from the surface of the saddle-type coils during the time dt. Therefore, the heat equilibrium can be represented by equation (1).

$$Q\cdot dt=c\cdot W\cdot d\theta+a\cdot A\cdot\theta\cdot dt \quad (1)$$

The following equation (2) is obtained by solving the equation (1) where the initial condition of the temperature rise θ is zero.

$$\theta=\theta_f(1-e^{-t/T}) \quad (2)$$

Here, $\theta_f$ indicates the final temperature of the saddle-type coils and T indicates time constant, both of which are obtained from the following equation (3) or (4).

$$\theta_f=Q/(a\cdot A) \quad (3)$$

$$T=c\cdot W/(a\cdot A) \quad (4)$$

When the radiation coefficient "a" is fixed, Q should be decreased or A should be increased compared to equation (3) in order to reduce the temperature rise of the saddle-type coils. Decreasing Q means to reduce the ohmic loss or eddy current loss of the saddle-type coils, or it means to decrease the consumption current by improving the deflection sensitivity of the saddle-type coils. Increasing "A" means to enlarge the surface area of the saddle-type coils.

Heat convection phenomenon should also be taken into consideration in improving the heat radiation effect of the saddle-type coils. As shown in FIG. 3, when an object of t° C. is in air of $t_o$° C. ($t>t_o$), the air near the surface of the object receives the object's heat by contact and radiation, and becomes lighter as its temperature rises. Thus, convections are generated so that the air takes away the heat. "$a_c$" indicates the heat which is taken away from a unit of surface area in a unit time due to this heat convection. The value of $a_c$ becomes bigger as the difference ($t-t_o$) between the temperatures of the object and that of the air is greater (cf. equation (5)).

$$a_c=C\cdot H^{-1/4}(t-t_o)^{5/4}[W/(m^2\cdot{}^\circ C.)] \quad (5)$$

In this equation, C indicates the constant and H indicates the height of the object. Therefore, the air contacting with the object should be as cool as possible so that the temperature rise of the saddle-type coils can be reduced.

Based on such reasons, the saddle-type coils of the cathode ray tube display of this invention improve, s the heat radiation effect. For this purpose, the surface area of the deflection yoke which is not surrounded with the ferrite core is enlarged so that the heat radiating surface area is increased and the heat convection is promoted.

DETAILED DESCRIPTION OF THE PREFERRED EMBODIMENTS

Figure 1:
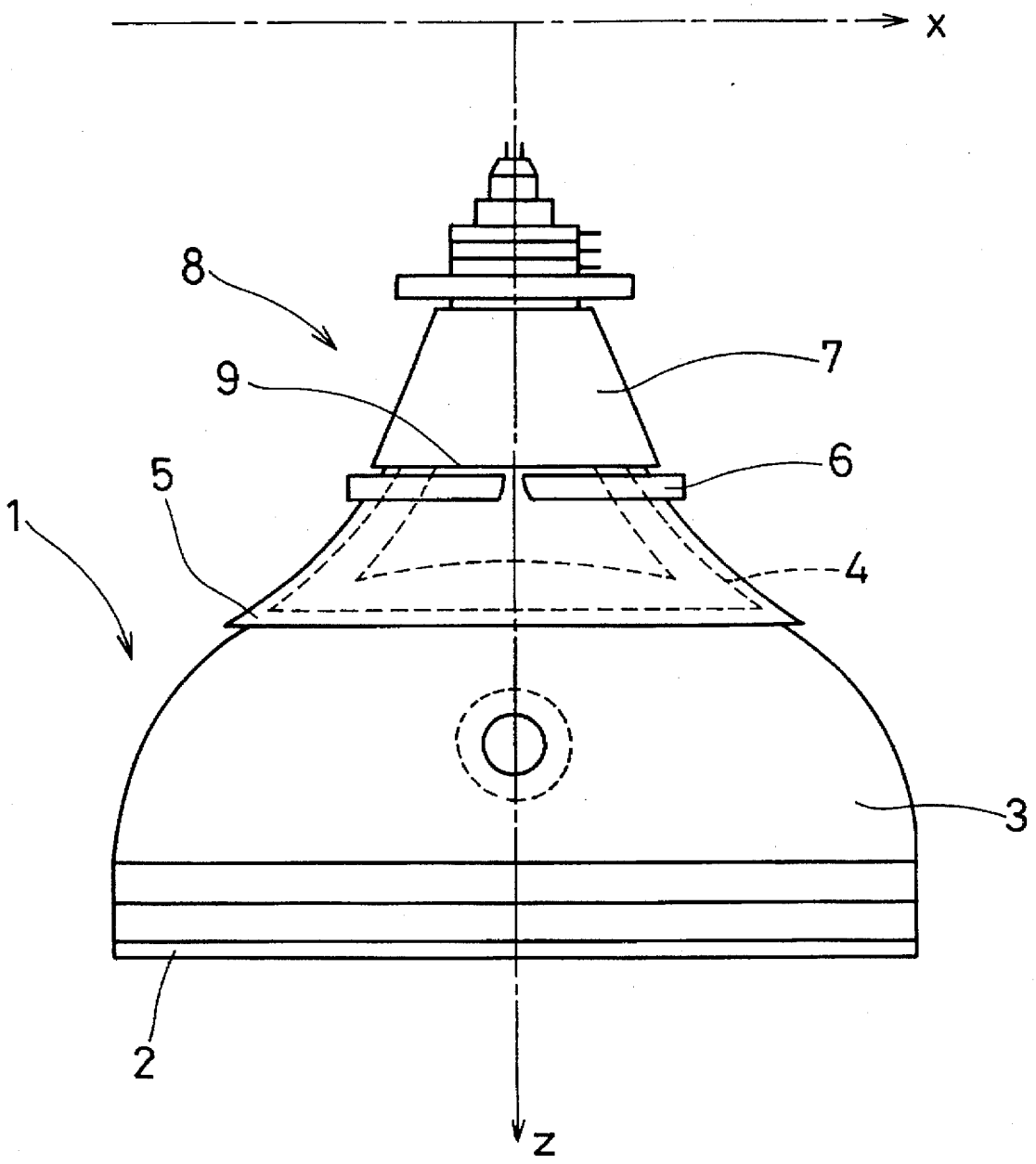
FIG. 1 is a plan view of a cathode ray tube display of the first embodiment of this invention.

The embodiments of this invention are explained below by referring to the drawings.

FIG. 1 is a plan view of a 41 cm(17")·90° cathode ray tube display according to the first embodiment of this invention. A cathode ray tube main body 1 comprises a glass panel 2 and a glass funnel 3 connected to the rear of the glass panel 2. An electron gun (not shown) is attached to the rear of the glass funnel 3. A deflection yoke 8 is attached to the rear periphery of the glass funnel 3. The deflection yoke 8 comprises a saddle-type horizontal deflection coil 4, an insulating frame 5 located outside the saddle-type horizontal deflection coil 4, a saddle-type vertical deflection coil 6 located outside the insulating frame 5, and a ferrite core 7 located outside the saddle-type vertical deflection coil 6. The saddle-type coils (4, 6) are formed by winding a bundle of normal wires (not litz wires) of 0.25 mm diameter. Numeral 9 indicates the screen-side end face of the ferrite core 7. The saddle-type horizontal deflection coil is partially exposed from the end face 9 toward the screen, and the surface area of the exposed part is set to be 185 $cm^2$.

Figure 4:
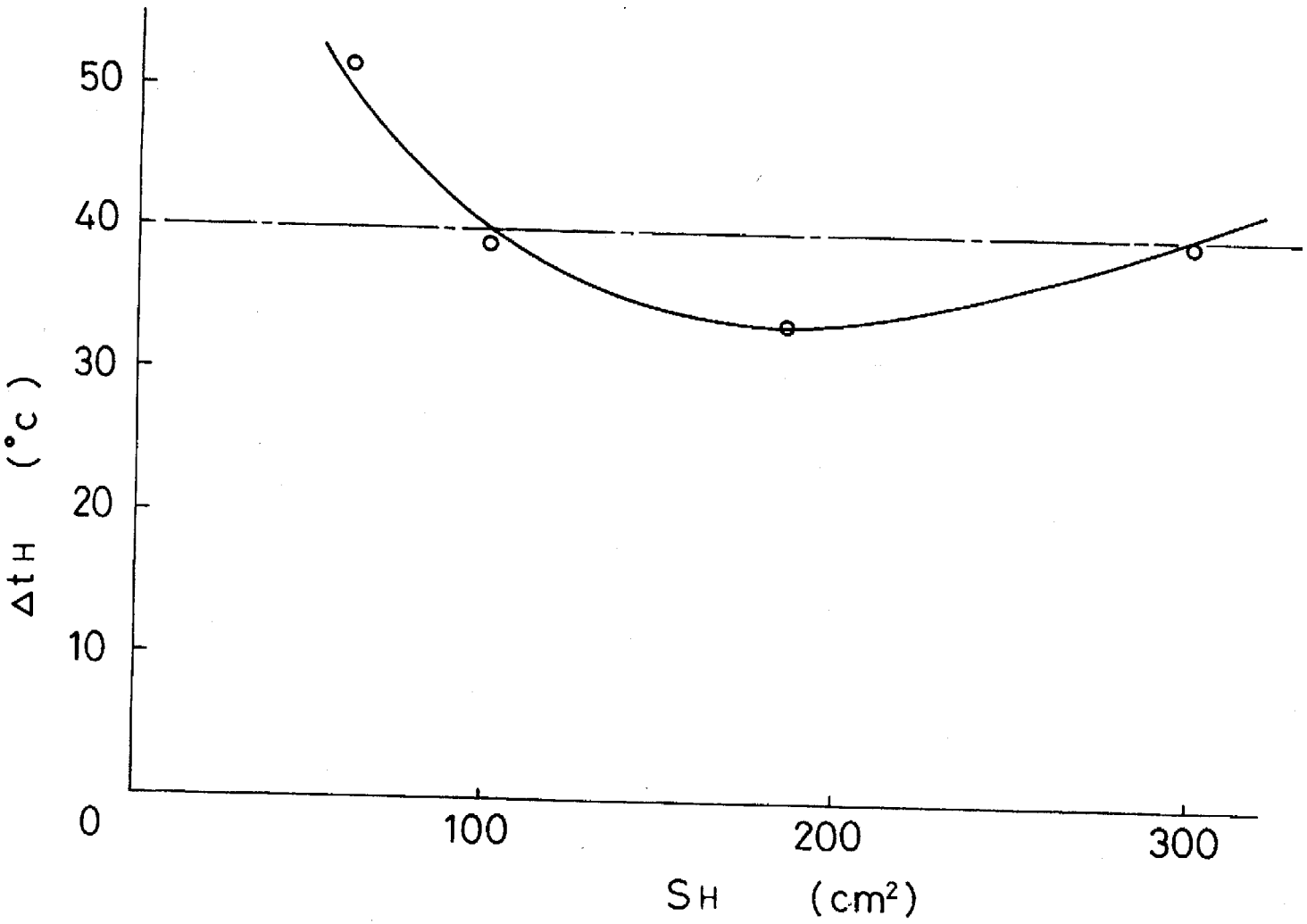
FIG. 4 is a graph showing the relation between the exposed surface area of the saddle-type horizontal deflection coil and the temperature rise of the same coil. The saddle-type horizontal deflection coil is partially exposed from the screen-side end face of the ferrite core of the deflection yoke toward the screen.

FIG. 4 indicates the relation between the exposed surface area $S_H$ of the saddle-type horizontal deflection coil 4 and the temperature rise $\Delta t_H$ of the same coil. The shapes and positions of the insulating frame 5, the saddle-type vertical deflection coil 6 and the ferrite core 7 are illustrated in FIG. 1. The deflection yoke 8 is operated such that the horizontal deflecting frequency is 82 kHz, the vertical deflection frequency is 71 Hz, anode voltage is 25 kV, and the raster size is 309×232 mm. The temperature rise $\Delta t_H$ of the saddle-type horizontal deflection coil 4 is defined by the difference between the highest temperature of the saddle-type horizontal deflection coil 4 and the average ambient temperature around the deflection yoke 8. The surface area $S_H$ is varied by fixing the wire winding angle and extending the coil to the screen side.

According to FIG. 4, the $\Delta t_H$ reducing effect appears when $S_H$ is 100 $cm^2$ or more. The value of $\Delta t_H$ is the smallest when $S_H$ is 185 $cm^2$, and later the value of $\Delta t_H$ increases. These results occur when the coil length of the saddle-type horizontal deflection coil 4 is extended to the screen side in order to increase $S_H$. As a result, the deflection center is shifted to the screen side and the deflection sensitivity is deteriorated, thus the $\Delta t_H$ reducing effect is decreased. When $S_H$ exceeds 298 $cm^2$, the $\Delta t_H$ reducing effect is lost. Therefore, the surface area $S_H$ is predetermined to be 185 $cm^2$ in this embodiment. However, the temperature rise $\Delta t_H$ of the saddle-type horizontal deflection coil 4 can be reduced if $S_H$ ranges from 100 to 298 $cm^2$.

Figure 2:
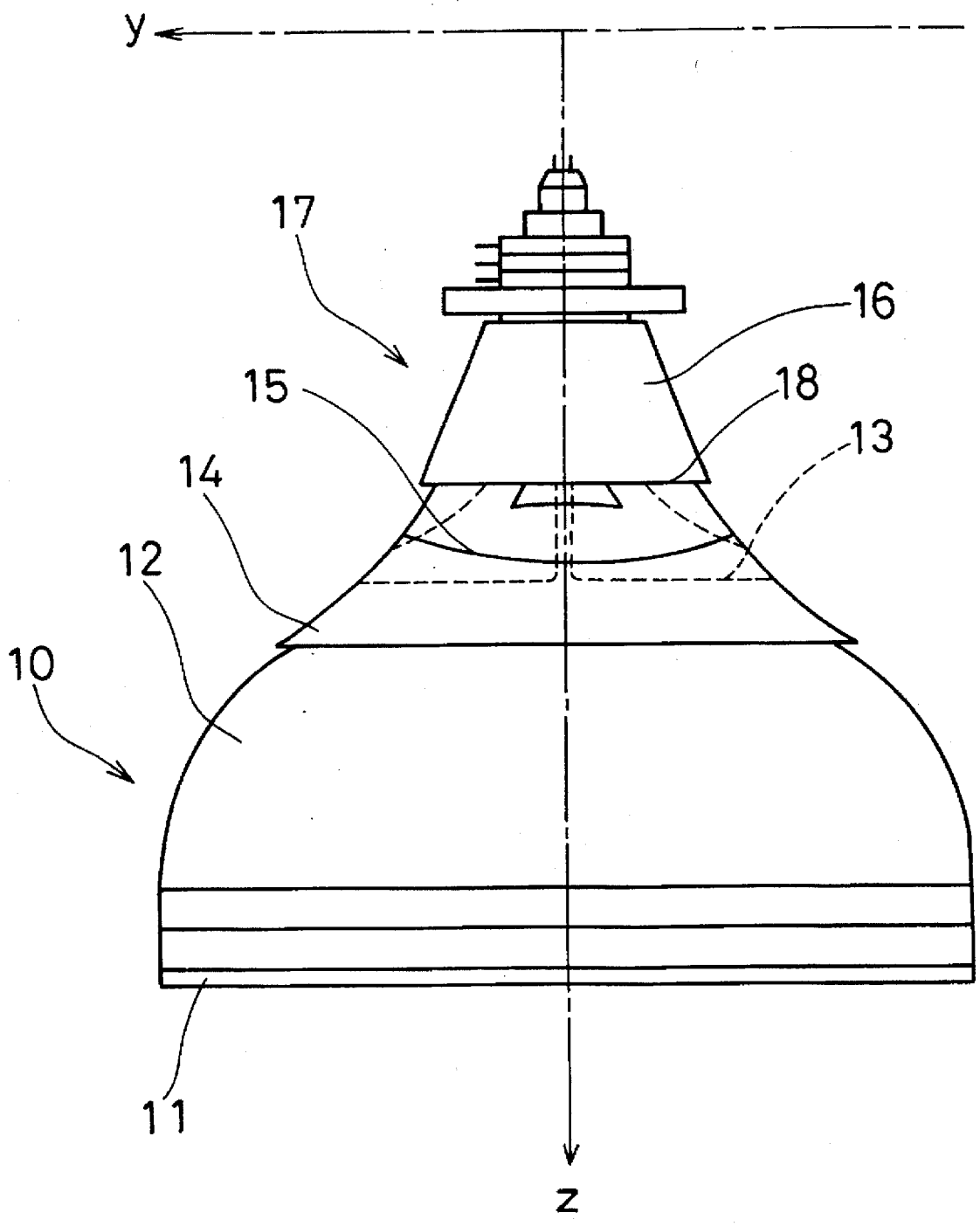
FIG. 2 is a side view of a cathode ray tube display of the second embodiment of this invention.
Figure 3:
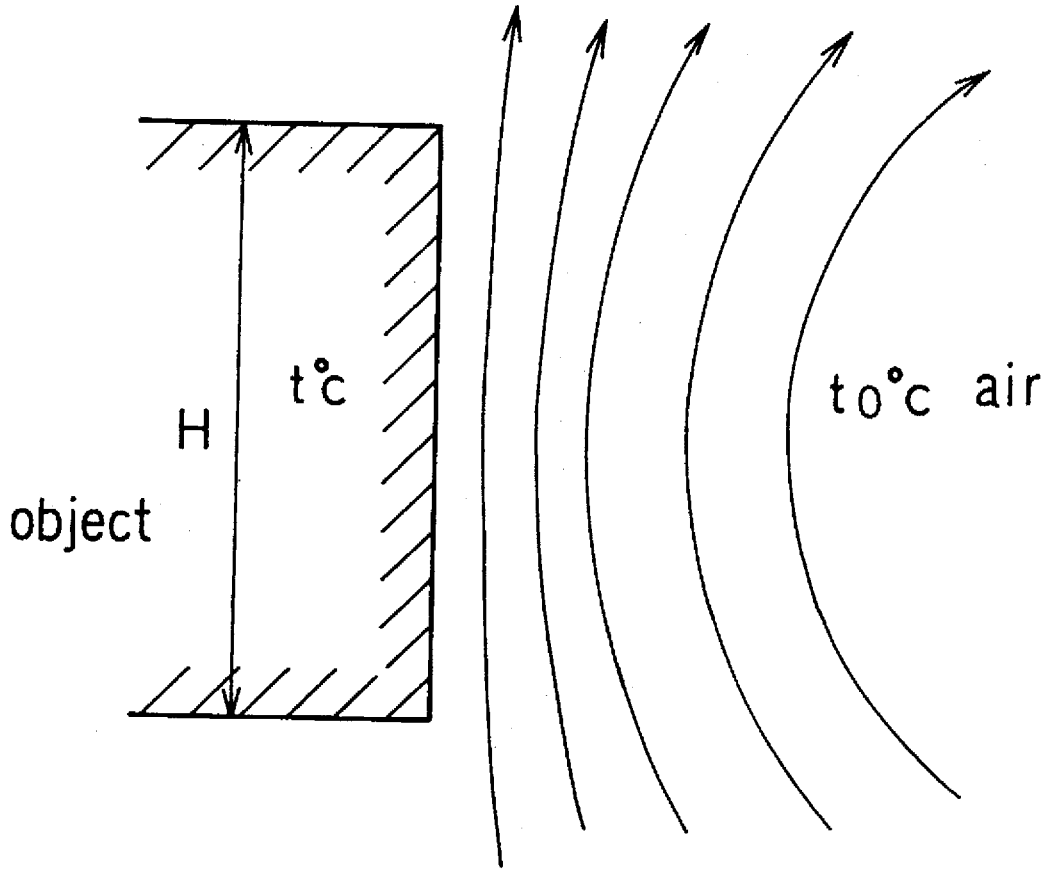
FIG. 3 is a schematic view describing heat radiation due to heat convection.

FIG. 2 is a side view of a 41 cm(17")·90° cathode ray tube display according to the second embodiment of this invention. Similar to the first embodiment, a cathode ray tube main body 10 comprises a glass panel 11 and a glass funnel 12 connected to the rear of the glass panel 11. An electron gun (not shown) is attached to the rear of the glass funnel 12. A deflection yoke 17 is attached to the rear periphery of the glass funnel 12. The deflection yoke 17 comprises a saddle-type horizontal deflection coil 13, an insulating frame 14 located outside the saddle-type horizontal deflection coil 13, a saddle-type vertical deflection coil 15 located outside the insulating frame 14, and a ferrite core 16 located outside the saddle-type vertical deflection coil 15. The saddle-type coils (13, 15) are formed by winding a bundle of normal wires (not litz wires) of 0.25 mm diameter. Numeral 18 indicates the screen-side end face of the ferrite core 16. The saddle-type vertical deflection coil is partially exposed from the end face 18 toward the screen, and the surface area of the exposed part is predetermined to be 115 $cm^2$.

Figure 5:
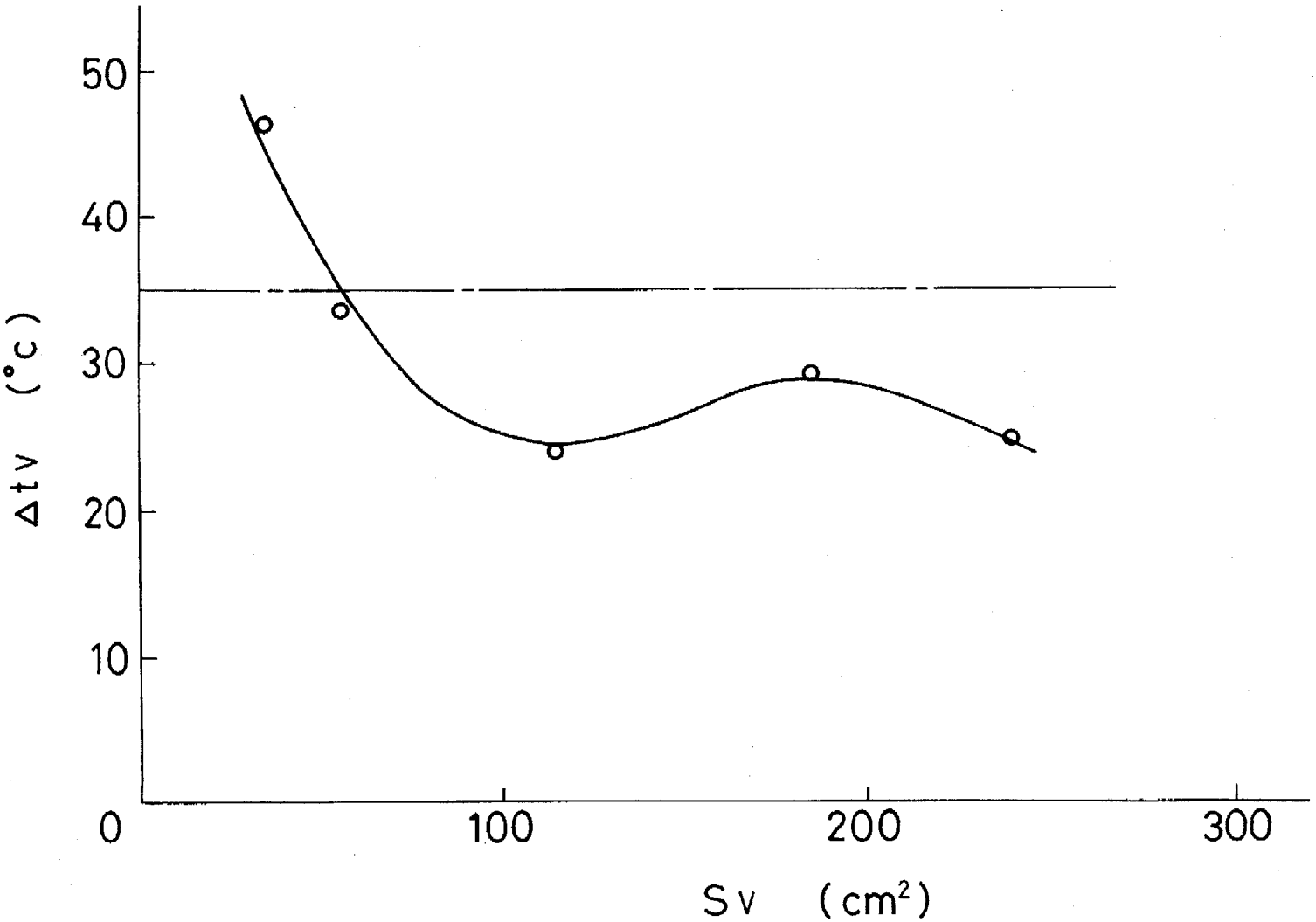
FIG. 5 is a graph showing the relation between the exposed surface area of the saddle-type vertical deflection coil and the temperature rise of the same coil. The saddle-type vertical deflection coil is partially exposed from the screen-side end face of the ferrite core of the deflection yoke toward the screen.

FIG. 5 indicates the relationship between the exposed surface area $S_v$ of the saddle-type vertical deflection coil 15 and the temperature rise $\Delta t_v$ of the same coil. The shapes and positions of the insulating frame 14, the saddle-type horizontal deflection coil 13 and the ferrite core 16 are shown in FIG. 2. The deflection yoke 17 is operated such that the horizontal deflecting frequency is 82 kHz, the vertical deflection frequency is 71 Hz, anode voltage is 25 kV, and the raster size is 309×232 mm. The temperature rise $\Delta t_v$ of the saddle-type vertical deflection coil 15 is defined by the difference between the highest temperature of the saddle-type vertical deflection coil 15 and the average ambient temperature around the deflection yoke 17. The surface area $S_v$ is varied by fixing the wire winding angle and extending the coil to the screen side.

According to FIG. 5, the $\Delta t_v$ reducing effect appears when $S_v$ is 55 $cm^2$ or more. The value of $\Delta t_v$ is lowest when $S_v$ is 115 $cm^2$.

Between an $S_v$ of 115 $cm^2$ and 185 $cm^2$ the value of $\Delta t_v$ continues to increase until, at 185 $cm^2$, $\Delta t_v$ again decreases. This result occurs because eddy current loss due to the increase of interlinkage between the horizontal deflection magnetic field and the saddle-type vertical deflection coil 15 as $S_v$ becomes bigger. The interlinkage and the eddy current loss are saturated if the value of $S_v$ exceeds 185 $cm^2$. When the value of $S_v$ exceeds 185 $cm^2$, the saddle-type vertical deflection coil 15 becomes too large, and the direct current resistance is increased. Such equipment cannot be practically used.

Therefore, the surface area $S_v$ is set to be 115 $cm^2$ in this embodiment. However, the temperature rise $\Delta t_v$ of the saddle-type vertical deflection coil 15 can be reduced if $S_v$ ranges from 55 to 185 $cm^2$.

The deflection yoke of each embodiment explained above comprises a saddle-type vertical deflection coil. However, the vertical deflection coil can be replaced by a troidal type coil. A troidal type vertical deflection coil can be wound on the ferrite core.

As mentioned above, the cathode ray tube display of this invention can improve its heat radiation effect and reduce temperature rise. For this purpose, the surface area of the saddle-type coil part which is exposed from the screen-side end face of the ferrite core of the deflection yoke toward the screen is enlarged in order to create the effect of expanding radiation surface area and convection of the heat. Therefore, neither expensive extra-fine wires nor litz wires are necessary for these saddle-type coils. In addition, the breakage of wires can be reduced during the coil winding process.

The invention maybe embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A cathode ray tube display comprising:

a cathode ray tube display main body having a glass panel and a glass funnel connected to the rear of the glass panel;

an electron gun attached to a rear section of said main body; and a deflection yoke arranged in a rear periphery portion of said main body, which comprises a saddle-shaped horizontal deflection coil, and an insulating frame located outside said saddle-shaped horizontal deflection coil, a vertical deflection coil and ferrite core located outside said insulating frame, wherein a surface area of said saddle-shaped horizontal deflection coil exposed from a screen-side end face of said ferrite core is within a range of 100 to 298 $cm^2$.

2. A cathode ray tube display comprising:

a cathode ray tube display main body having a glass panel and a glass funnel connected to the rear of the glass panel;

an electron gun attached to a rear section of the main body; and a deflection yoke arranged in a rear periphery portion of said main body, which comprises a saddle-shaped horizontal deflection coil, and an insulating frame located outside said saddle-shaped horizontal deflection coil, a saddle-shaped vertical deflection coil and ferrite core located outside said insulating frame, wherein a surface area of said saddle-shaped vertical deflection coil exposed from a screen-side end face of said ferrite core is within a range of 55 to 185 $cm^2$.

* * * * *